US010763057B2

(12) United States Patent
Chang

(10) Patent No.: US 10,763,057 B2
(45) Date of Patent: Sep. 1, 2020

(54) WATERPROOF KEYBOARD STRUCTURE AND ASSEMBLY METHOD THEREOF

(71) Applicant: GETAC TECHNOLOGY CORPORATION, Hsinchu County (TW)

(72) Inventor: Juei-Chi Chang, Taipei (TW)

(73) Assignee: GETAC TECHNOLOGY CORPORATION, Hsinchu County (TW)

( * ) Notice: Subject to any disclaimer, the term of this patent is extended or adjusted under 35 U.S.C. 154(b) by 0 days.

(21) Appl. No.: 16/262,794

(22) Filed: Jan. 30, 2019

(65) Prior Publication Data

US 2020/0027672 A1 Jan. 23, 2020

Related U.S. Application Data

(60) Provisional application No. 62/701,964, filed on Jul. 23, 2018.

(51) Int. Cl.
*H01H 13/86* (2006.01)

(52) U.S. Cl.
CPC ..... *H01H 13/86* (2013.01); *H01H 2221/076* (2013.01); *H01H 2223/003* (2013.01); *H01H 2223/056* (2013.01); *H01H 2231/002* (2013.01); *H01H 2233/046* (2013.01)

(58) Field of Classification Search
CPC ..... H01H 2223/002; H01H 2223/003; H01H 13/705; H01H 13/704; H01H 13/86; G06F 3/0219
See application file for complete search history.

(56) References Cited

U.S. PATENT DOCUMENTS 6,573,463 B2 * 6/2003 Ono ..... B29C 45/1418 200/302.2
9,904,326 B2 * 2/2018 Lin ..... G06F 1/1656

* cited by examiner

*Primary Examiner* — Vanessa Girardi

(57) ABSTRACT

A waterproof keyboard structure and an assembly method thereof are provided. The waterproof keyboard structure includes a keyboard module, and a keyboard frame framing on the keyboard module, wherein an elastic waterproof layer is formed by means of double injection or insert molding on the keyboard frame. The keyboard module is defined with a key surface, and an assembly surface arranged opposite to the key surface. The elastic waterproof layer is clad on the key surface, and the keyboard module with the assembly surface facing a seat is assembled together with the keyboard frame in an accommodating space, thereby having the elastic waterproof layer closely fit with the seat to form a waterproof ring.

18 Claims, 5 Drawing Sheets

WATERPROOF KEYBOARD STRUCTURE AND ASSEMBLY METHOD THEREOF

CROSS-REFERENCE TO RELATED APPLICATIONS

The present application claims the benefit of U.S. provisional Patent Application No. 62/701,964, filed on Jul. 23, 2018, the disclosure of which is hereby incorporated by reference herein in its entirety.

BACKGROUND OF THE INVENTION

Field of the Invention

The present invention relates to keyboards and, more particularly, to a waterproof keyboard structure and an assembly method thereof.

Description of the Prior Art

With the rapid developments of the technology industries such as computers, many electronic products are operated through an input device such as a keyboard. However, in outdoor, indoor or even harsh environments, foreign objects such as water or dust can enter an input device and easily cause damage. Furthermore, keys on a keyboard are provided with labels such as symbols and characters for an operator to easily identify and enter a correct instruction. However, these exposed keys are susceptible to issues such as identification difficulties due to the wear of the labels after the keyboard is used for an extended period of time.

Thus, a waterproof film is used to cover the keys in a conventional input device, and the waterproof film is formed in a recessed or protruding manner to adapt to positions and shapes of the keys. With the covering and configuration of the waterproof film, objects and effects of being waterproof and dustproof as well as protecting labels on key caps are achieved. However, since the waterproof film only covers surfaces of the keys and can be removed at all times, water seepage can still be incurred. Thus, the above conventional approach is not entirely ideal. However, if the waterproof film is adhered on the surfaces of the keys, after the surfaces of the key caps of the keys are adhered to an inner surface of the waterproof film, the waterproof film can be easily deformed when the keys are pressed and tapped. Furthermore, press strokes of the keys may be affected due to the material of the waterproof film; for example, a material having a smaller level of deformation or less satisfactory deformation ability can cause a press stroke to be shortened, resulting in a degraded hand feel for tapping or pressing of an operator and affecting the precision of input keys.

In view of the above, to improve and solve the above issues, the Applicant provides, on the basis of extensive search with the exercise of theories, the present invention having a reasonable design for effectively improving the above issues.

SUMMARY OF THE INVENTION

It is a primary object of the present invention to provide a waterproof keyboard structure and an assembly method thereof, wherein the waterproof keyboard structure can be easily assembled to, for example, a laptop computer, and the waterproof keyboard structure and the assembly method have waterproof and dustproof effects while maintaining a good hand feel for tapping and pressing.

To achieve the above object, the present invention provides a waterproof keyboard structure including a keyboard module, and a keyboard frame framing on the keyboard module. An elastic waterproof layer is formed by means of double injection or insert molding on the keyboard frame. The elastic waterproof layer includes a clad layer covering a surface of the keyboard module, and a flange extending from a periphery of the clad layer. The flange thereon has a sealing ring protruding outwards and continually encircling the keyboard frame.

To achieve the above object, the present invention provides an assembly method of a waterproof keyboard structure. The assembly method includes steps of: a) preparing a seat and a keyboard module, wherein the seat has an accommodating space, and the keyboard module is defined with a key surface and an assembly surface arranged opposite to the key surface; b) cladding an elastic waterproof layer by means of double injection or insert molding on a keyboard frame; c) assembling the keyboard frame and the elastic waterproof layer to the keyboard module; d) assembling the keyboard module with the assembly surface facing the seat together with the keyboard frame in the accommodating space; and e) having the elastic waterproof layer closely fit with the seat to form a waterproof ring.

To achieve the above object, the present invention provides a waterproof keyboard structure. The waterproof keyboard structure includes a seat having an accommodating space, a keyboard module provided in the accommodating space, and a keyboard frame framing on the keyboard module. The keyboard frame is cladded with an elastic waterproof layer, and the elastic waterproof layer closely fits with the seat to form a waterproof ring.

DETAILED DESCRIPTION OF THE EMBODIMENTS

To enable the Examiner to further understand features and technical contents of the present invention, the present invention is described in detail with the accompanying drawings below. However, the drawings are only for reference and illustration purposes, and are not to be construed as limitations to the present invention.

Figure 1:
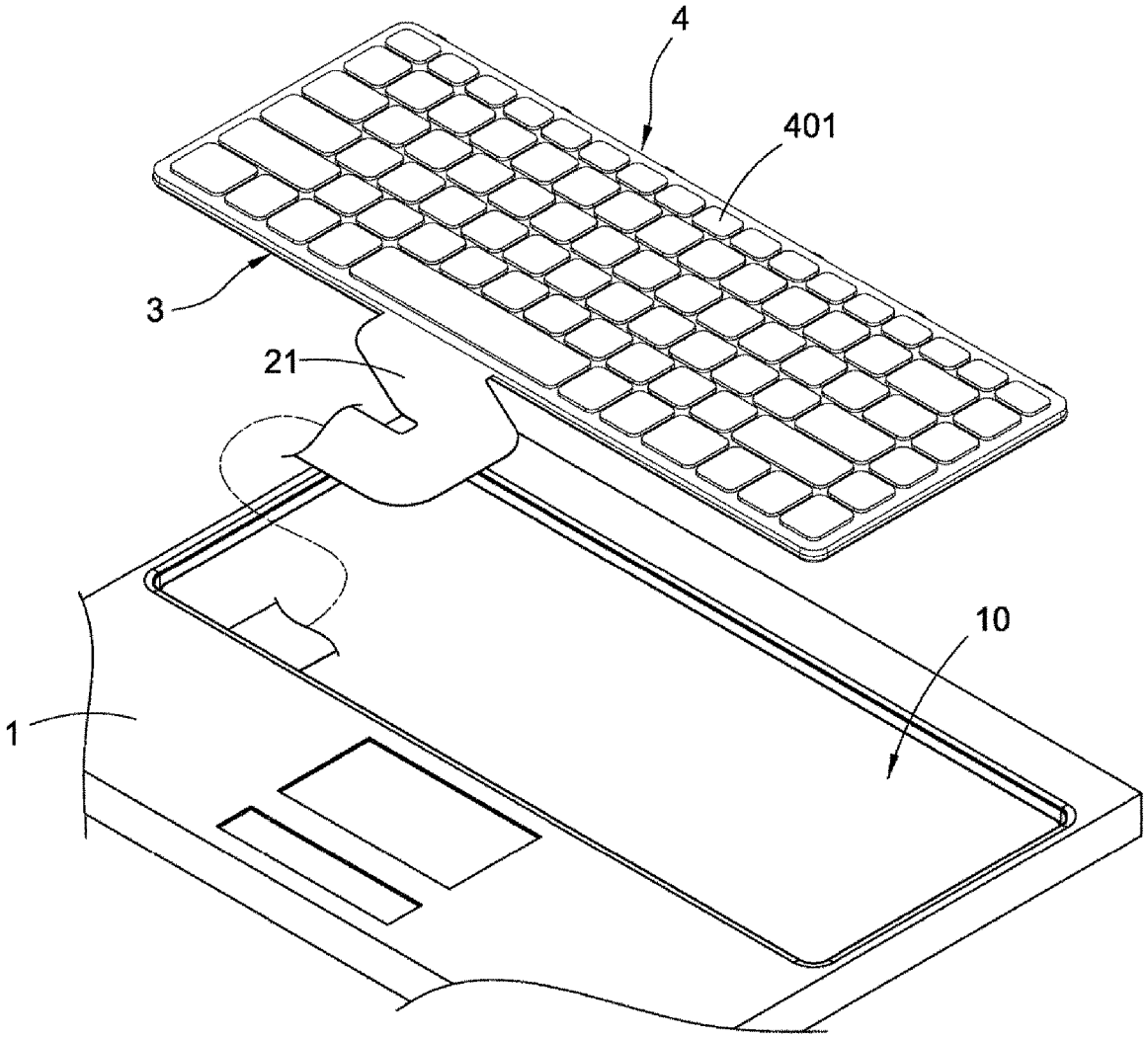
FIG. 1 is an exploded perspective schematic diagram of a waterproof keyboard and a seat of the present invention.
Figure 2:
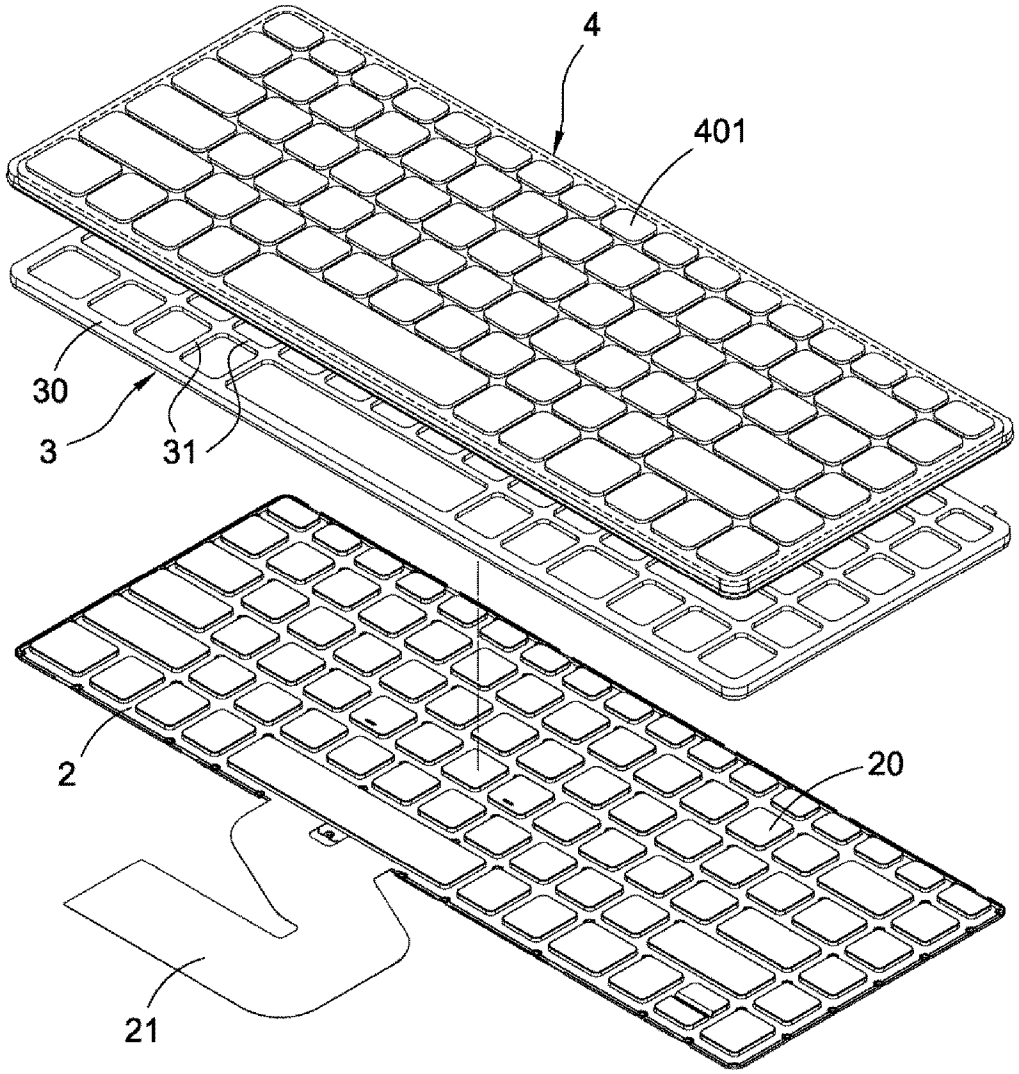
FIG. 2 is an exploded perspective diagram of the present invention.

FIG. 1 and FIG. 2 respectively show an exploded perspective schematic diagram of a waterproof keyboard and a seat of the present invention and an exploded perspective diagram of the present invention. The present invention provides a waterproof keyboard structure which can be easily assembled to a laptop computer, as that installed on a seat 1 of the laptop computer in FIG. 1, providing waterproof and dustproof effects while maintaining a good hand feel for tapping and pressing. As shown in FIG. 2, the waterproof keyboard structure includes a keyboard module 2 and a keyboard frame 3.

Figure 3:
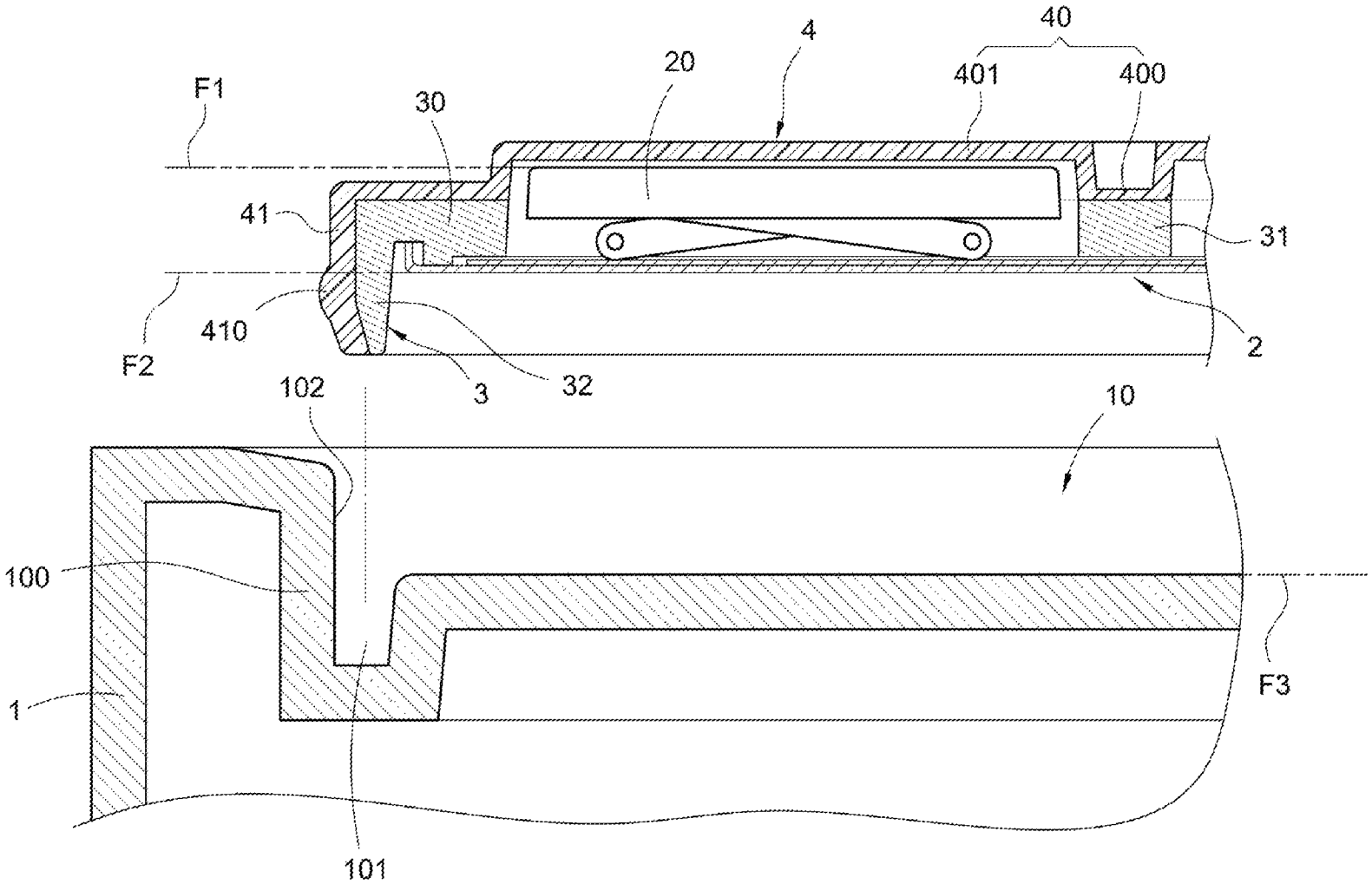
FIG. 3 is a sectional schematic diagram of an operation before placing a waterproof keyboard into a seat of the present invention.

The keyboard module 2 is primarily formed by arranging a plurality of keys 20, and each of the keys 20 corresponds to a circuit board 21, wherein the circuit board 21 may be a thin-film circuit board. A conduction point (not shown) corresponding to the underneath of each key 20 is formed through the thin-film circuit, so as to transmit a corresponding instruction through the circuit board 21 by coming into contact with the conduction point when each key 20 is pressed, achieving the object of inputting an instruction. Furthermore, as shown in FIG. 3, through the configuration of the keys 20 on the circuit board 21, the keyboard module 2 is defined with a key surface F1 formed by the keys 20, and an assembly surface F2 arranged opposite to the key surface F1. The assembly surface F2 is a back surface of the circuit board 21, and the back surface is not provided with any keys 20.

Again referring to FIG. 2 and FIG. 3, the keyboard frame 3 is for framing on the keyboard module 2, and includes a frame body 30 stacked on the keyboard module 2 and a grating structure 31 integrally formed in the frame body 30, wherein the grating structure 31 corresponds to the outside of the plurality of keys 20 of the keyboard module 2.

In continuation of the above, in the present invention, an elastic waterproof layer 4 is formed by means of double injection or inserting molding on the keyboard frame 3. The elastic waterproof layer 4 is adhered and fixed on the frame body 30 of the keyboard frame 3, and includes a clad layer 40 covering the surface (i.e., the key surface F1) of the keyboard module 2 and a flange 41 extending from the periphery of the clad layer 40. The flange 41 includes a sealing ring 410 that protrudes outwards and continually encircles the keyboard frame 3, and the keyboard frame 3 and the elastic waterproof layer 4 are assembled on the keyboard module 2. More specifically, the clad layer 40 has rib portions 400 corresponding to and adhered to the grating structure 31 of the keyboard frame 3, and a plurality of protective films 401 integrally formed among the rib portions 400. The protective films 401 respectively correspond to and cover the keys 20, and are spaced from the surfaces of the corresponding keys 20 by a distance d. In other words, inner surfaces of the protective films 401 are not adhered to the surfaces of the keys 20.

Figure 4:
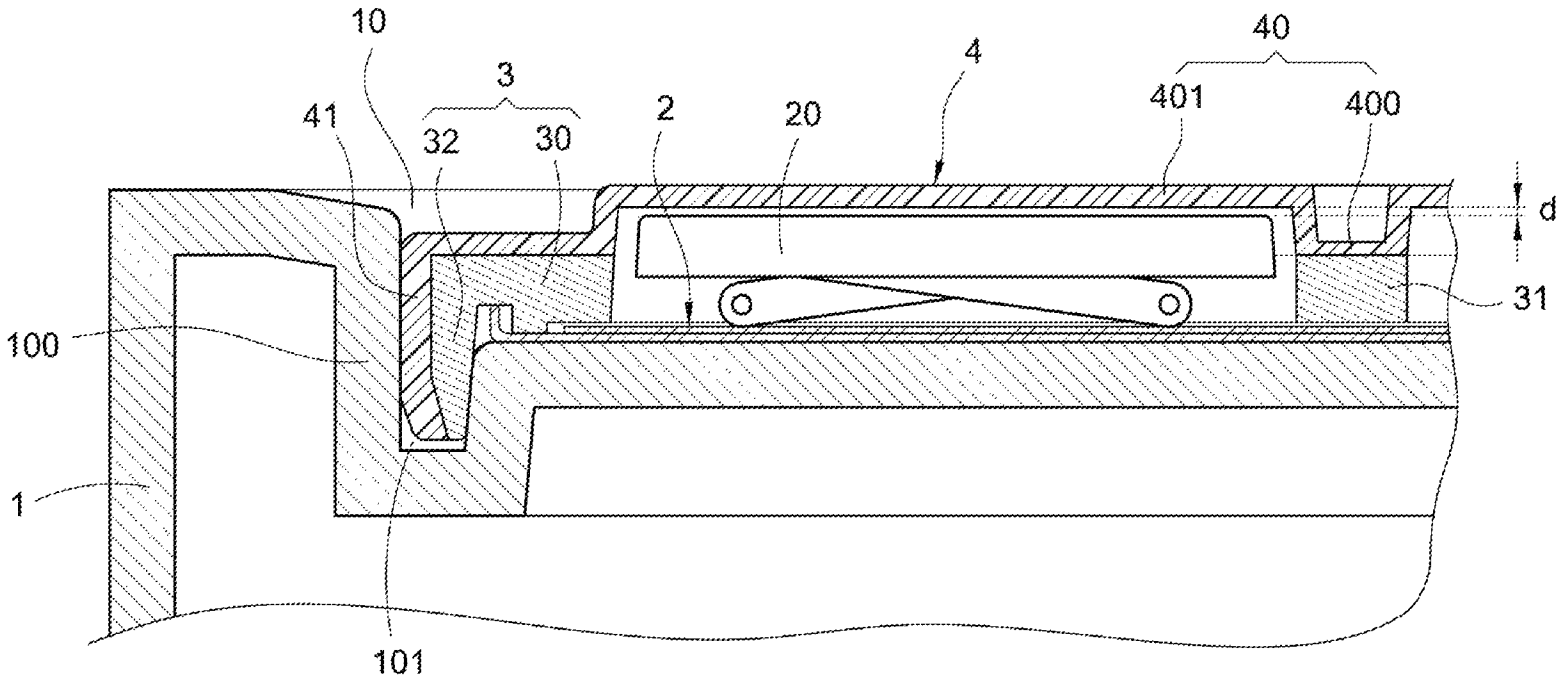
FIG. 4 is a sectional schematic diagram of an operation after placing a waterproof keyboard into a seat of the present invention.

Next, as shown in FIG. 1 and FIG. 4, an accommodating space 10 is provided on the seat 1 of the laptop computer, the seat 1 having a support surface F3, and the keyboard module 2 having the assembly surface F2 facing the seat 1 is together with the keyboard frame 3 assembled in the accommodating space 10 such that the assembly surface F2 abuts or directly contacts the support surface F3. Accordingly, the flange 41 of the elastic waterproof layer 4 closely fits with the seat 1, such that a waterproof ring is jointly formed between the elastic sealing ring 410 and an inner wall 100 of the accommodating space 10 when the sealing ring 410 is pressed and deformed by an inner surface 102 of the inner wall 100 of the accommodating space 10. Furthermore, the elastic waterproof layer 4 is made of liquid silicone rubber, and forms a covalent bond at the interface between the elastic waterproof layer 4 and the keyboard frame 3.

Moreover, as shown in FIG. 4, the keyboard frame 3 further includes an embedding portion 32 extending downwards from the periphery of the frame body 30. The embedding portion 32 is clamped between the keyboard module 2 and the inner wall 100 of the accommodating space 10, a fastening groove 101 surrounding the inner wall 100 and recessed downwards is formed in the accommodating space 10, and the embedding portion 32 is further fastened in the fastening groove 101. With the above assembly and matching structure, the joining stability between the keyboard module 2 and the seat 1 is further reinforced, thereby enhancing the close-fit effect of the elastic waterproof layer 4. In other words, since the flange 41 is closely fitted between the embedding portion 32 and the inner wall 100 of the accommodating space 10, the tighter the close-fit effect applied to the elastic waterproof layer 4 is, the better waterproof effect is achieved. In addition, the embedding portion 32 can further increase the contact area between the elastic waterproof layer 4 and the inner wall 100 of the accommodating space 10, thus similarly further enhancing the waterproofness. More accurately, the sealing ring 410 on the flange 41 protrudes towards the inner wall 100 of the accommodating space 10 and is limited in the fastening groove 101, and so the tighter the close-fit effect applied to the sealing ring 410 is, the better waterproofness is achieved.

Thus, with the above structure and composition, the waterproof keyboard structure of the present invention is obtained.

Figure 5:
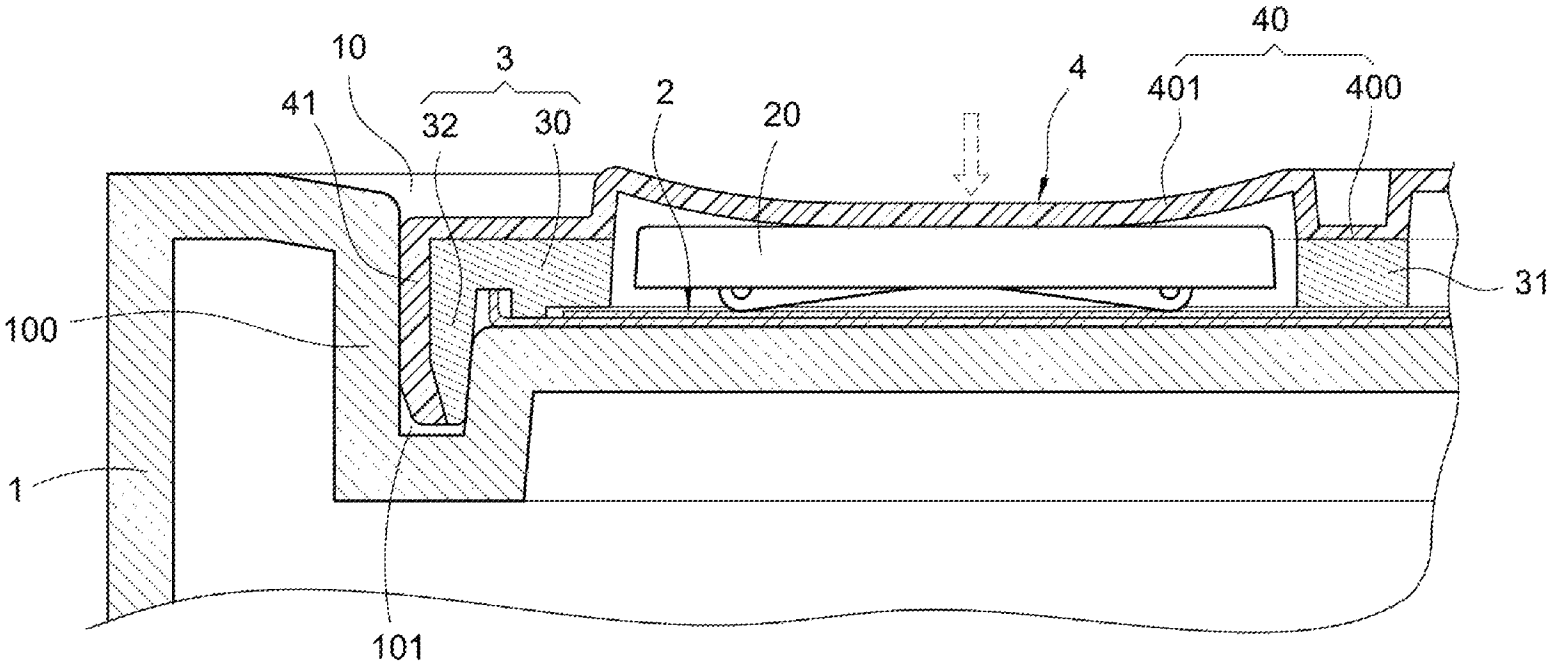
FIG. 5 is a sectional schematic diagram of an operation of a waterproof keyboard of the present invention in a pressed state.

Accordingly, as shown in FIG. 5, in the present invention, the protective films 401 of the elastic waterproof layer 4 respectively correspond to and cover the keys 20, and are spaced from the surfaces of the corresponding keys 20 by the distance d, that is, the protective films 401 are not adhered and fixed to the surfaces of the keys 20. Hence, when the keys 20 are tapped or pressed, the protective films 401 are provided with a sufficient amount of deformation and do not become deformed by the press strokes of the keys 20. Furthermore, the keys 20 are not affected by adhered and fixed protective films 401 during the press strokes thereof. That is to say, the keys 20 respectively receive a force and become deformed or receive a force and become pressed downwards without interfering one another. As such, under the premise that waterproof and dustproof effects are achieved and the labels on the surfaces of the keys 20 are protected, the press strokes of the keys 20 are further maintained to prevent from affecting the hand feel for tapping the keys 20.

In conclusion, the present invention achieves the expected application result, solves the issues of the prior art, and involves novelty and an inventive step, which meet the requirements of a patent application. Therefore, a patent application is filed accordingly, and granting the application with patent rights is respectfully requested to ensure rights of the Inventor.

While the invention has been described by way of the preferred embodiments above, it is to be understood that the scope of the present invention is not limited thereto. Equivalent techniques and means made on the basis of the description and drawings of the disclosure of the present invention are thus encompassed within the scope of the present invention.

What is claimed is:

1. A waterproof keyboard structure, comprising:

a seat, having an accommodating space comprising an inner wall, wherein an inner surface of the inner wall surrounds and faces an interior of the accommodating space;

a keyboard module;

a keyboard frame, assembled with the keyboard module and disposed in the accommodating space along with the keyboard module; and an elastic waterproof layer molded to a periphery of the keyboard frame and covering the keyboard module, wherein a periphery of the elastic waterproof layer is compressed by the inner surface of the inner wall of the accommodating space to form a waterproof ring.

2. The waterproof keyboard structure according to claim 1, wherein the keyboard frame comprises a frame body and an embedding portion extending downwards from a periphery of the frame body, wherein the elastic waterproof layer comprises a flange molded to the embedding portion, the flange comprising a sealing ring protruding outwards and continuously encircling the keyboard frame, wherein the sealing ring is compressed by the inner wall of the accommodating space to form the waterproof ring.

3. The waterproof keyboard structure according to claim 1, wherein the seat comprises a support surface surrounded by a fastening groove, the keyboard module abuts or directly contacts the support surface, and a portion of the periphery of the elastic waterproof layer flange is inserted into the fastening groove.

4. A waterproof keyboard structure, comprising:

a keyboard module;

a keyboard frame, disposed on the keyboard module;

a seat having an accommodating space defined by an inner wall, wherein an inner surface of the inner wall surrounds and faces an interior of the accommodating space, wherein the keyboard module and the keyboard frame are disposed in the accommodating space; and an elastic waterproof layer formed by means of double injection or insert molding on the keyboard frame;

wherein the elastic waterproof layer comprises a clad layer covering a surface of the keyboard module, and a flange extending from a periphery of the clad layer, the flange comprising a sealing ring protruding outwards and continuously encircling the keyboard frame, and the sealing ring is pressed against the inner surface of the inner wall of the accommodating space to form a waterproof ring;

wherein the keyboard frame comprises a frame body stacked on the keyboard module, and the elastic waterproof layer is adhered and fixed on the frame body; and wherein the keyboard frame further comprises a grating structure integrally formed with the frame body, and the grating structure comprises a plurality of openings corresponding respectively to a plurality of keys of the keyboard module.

5. The waterproof keyboard structure according to claim 4, wherein each key of the keyboard module is received in a respective one of the openings.

6. The waterproof keyboard structure according to claim 4, wherein the seat comprises a support surface surrounded by a fastening groove, the keyboard module abuts or directly contacts the support surface, and the flange is inserted into the fastening groove.

7. The waterproof keyboard structure according to claim 4, wherein the clad layer comprises rib portions corresponding to and adhered on the grating structure, and a plurality of protective films integrally formed among the rib portions, and wherein the protective films respectively correspond to and cover the keys.

8. The waterproof keyboard structure according to claim 7, wherein the elastic waterproof layer is made of liquid silicone rubber, and an interface between the elastic waterproof layer and the keyboard frame forms a covalent bond.

9. A waterproof keyboard structure, comprising:

a seat comprising an inner wall and a fastening groove, the inner wall defining an accommodating space, wherein an inner surface of the inner wall inner wall surrounds and faces an interior of the accommodating space, and the fastening groove is recessed downwards along the inner surface of the inner wall and is interior to the accommodating space;

a keyboard module, disposed in the accommodating space;

a keyboard frame, disposed on the keyboard module; and an elastic waterproof layer cladded on the keyboard frame, the elastic waterproof layer closely fitting with the seat to form a waterproof ring;

wherein the keyboard frame comprises a frame body stacked on the keyboard module, and the elastic waterproof layer is adhered and fixed on the frame body; and wherein the keyboard frame further comprises an embedding portion extending downwards from a periphery of the frame body, the embedding portion is clamped between the keyboard module and the inner wall of the accommodating space, and the embedding portion is further fastened in the fastening groove.

10. The waterproof keyboard structure according to claim 9, wherein the keyboard frame further comprises a grating structure integrally formed with the frame body, and the grating structure comprises a plurality of openings corresponding respectively to a plurality of keys of the keyboard module.

11. The waterproof keyboard structure according to claim 9, wherein the seat comprises a fastening groove surrounding the support surface and the keyboard module abuts or directly contacts the support surface.

12. The waterproof keyboard structure according to claim 9, wherein the elastic waterproof layer is formed by means of double injection or insert molding on the frame body.

13. The waterproof keyboard structure according to claim 12, wherein the elastic waterproof layer is made of liquid silicone rubber, and an interface between the elastic waterproof layer and the keyboard frame forms a covalent bond.

14. The waterproof keyboard structure according to claim 9, wherein the elastic waterproof layer comprises a clad layer covering a surface of the keyboard module, and a flange extending from a periphery of the clad layer and closely fitted between the embedding portion and the inner wall of the accommodating space.

15. The waterproof keyboard structure according to claim 14, wherein the flange comprises a sealing ring continuously encircling the keyboard frame.

16. The waterproof keyboard structure according to claim 15, wherein the sealing ring protrudes towards the inner wall of the accommodating space and is limited in the fastening groove.

17. An assembly method of a waterproof keyboard structure, comprising:

a) preparing a seat and a keyboard module, the seat comprising a support surface and an inner wall defining an accommodating space, the keyboard module comprising with a keyboard surface and an assembly surface arranged opposite to the keyboard surface;

b) cladding an elastic waterproof layer by means of double injection and insert molding on a keyboard frame;

c) assembling the keyboard frame and the elastic waterproof layer to the keyboard module, wherein the keyboard frame comprises a frame body stacked on the keyboard module and an embedding portion extending downwards from a periphery of the frame body, and the elastic waterproof layer is adhered and fixed on the frame body; and d) assembling the keyboard module and the keyboard frame in the accommodating space with the assembly surface abutting or directly contacting the support surface of the seat together such that the embedding portion is clamped between the keyboard module and an inner wall of the accommodating space, wherein the elastic waterproof layer comprises a clad layer covering a surface of the keyboard module and a flange extending from a periphery of the clad layer and closely fitted between the embedding portion and the inner wall of the accommodating space, and the flange comprises a sealing ring continuously encircling the keyboard frame;

wherein the when the keyboard module is assembled with the accommodating space, the sealing ring is compressed by the inner wall of the accommodating space to form a waterproof ring.

18. The assembly method of a waterproof keyboard structure according to claim 17, wherein the seat comprising the support surface is surrounded by a fastening groove and the embedding portion is inserted into the fastening groove.

* * * * *